United States Patent [19]

Wright

[11] Patent Number: 4,746,271

[45] Date of Patent: May 24, 1988

[54] SYNTHETIC FAN BLADE

[75] Inventor: Jamie C. Wright, Mason, Mich.

[73] Assignee: Hayes-Albion Corporation, Jackson, Mich.

[21] Appl. No.: 29,975

[22] Filed: Mar. 25, 1987

[51] Int. Cl.[4] ..... B63H 1/06; B63H 1/26

[52] U.S. Cl. ..... 416/132 A; 416/241 A; 416/243; 416/210 R; 416/236 R; 416/223 R; 416/248

[58] Field of Search ..... 416/241 A, 243 A, DIG. 3, 416/237, 132 A, 210 R, 212 R, 236 R, 223 R, 242, 243 R, 248, 230

[56] References Cited

U.S. PATENT DOCUMENTS

| | | | |
|---|---|---|---|
| 3,749,518 | 7/1973 | Alver et al. | 416/230 |
| 3,751,181 | 8/1973 | Hayashi | 416/132 |
| 3,846,045 | 11/1974 | Mincuzzi | 416/230 |
| 4,003,677 | 1/1977 | Parkes | 416/208 |
| 4,063,852 | 12/1977 | O'Connor | 416/223 R |
| 4,142,844 | 3/1979 | Brattstrom | 416/243 |
| 4,357,913 | 11/1982 | Hori et al. | 123/41.49 |
| 4,363,602 | 12/1982 | Martin | 416/230 |
| 4,671,739 | 6/1987 | Read et al. | 416/230 |

FOREIGN PATENT DOCUMENTS

| | | | |
|---|---|---|---|
| 483934 | 4/1938 | United Kingdom | 416/243 |

*Primary Examiner*—Robert E. Garrett
*Assistant Examiner*—Therese Newholm
*Attorney, Agent, or Firm*—Beaman & Beaman

[57] ABSTRACT

The invention pertains to a fan blade and a method for making a fan blade wherein the stresses within the blade material are substantially constant throughout the length of the blade and the unique construction of the blade reduces the concentration of loading on the blade material. Preferably, the blade is molded of a synthetic plastic material and includes a ribbed structure locating material offset from the concave convex configuration of the blade air flow portion such that the section modulus of blade sections from the air flow portion toward the root portion increases by increasing the distance of the blade material from the neutral bending axis in such a manner that no abrupt changes occur and the stresses imposed upon the blade material throughout its length are substantially constant. The basic concept of the invention is achieved by the most advantageous location of the blade material relative to its neutral bending axis, and the practice of the invention permits the blade to most efficiently utilize the material while withstanding the forces and stresses imposed thereon resulting in significant economies of manufacture.

8 Claims, 3 Drawing Sheets

SYNTHETIC FAN BLADE

BACKGROUND OF THE INVENTION

Basically, a fan blade assembly includes hub structure from which elongated blades radially extend. The hub structure is mounted upon a drive shaft driven by an electric motor, an automobile engine or the like. The fan blades may be riveted to the hub, homogeneously formed of the hub material or may be otherwise affixed. The hub and blades may be of metal and it is also known to mold the entire fan blade assembly, including the hub and the blades, of synthetic plastic material, and in some applications metal hubs are utilized having synthetic plastic blades affixed thereto.

The bending forces imposed upon a fan blade during operation result from a plurality of factors. The rapid rotation of the fan blade imposes centrifugal and centripetal forces on the blades, a variety of vibrational forces are imposed thereon, torsion forces exist endeavoring to twist the blade about its longitudinal axis, and primary bending forces are imposed on the blade resulting from the reaction forces due to the blade's displacement of air as it rotates. These latter forces are particularly significant as they are directed substantially transverse to the thinnest dimension of the blade.

It has long been recognized that the greatest stresses imposed upon fan blades occur at the blade locations adjacent the hub. At such locations the entire bending forces imposed on the blade must be resisted, as well as forces resulting from the blade rotation and tendency to twist, and the most common manner to prevent failure at the root of the blade adjacent the hub is to use reinforcement at this location, such as by widening the blade, using a high strength material, or increasing the blade thickness. These constructions significantly add to the blade cost.

When molding a fan blade of synthetic plastic material the thickness of the blade may be very accurately controlled, as may the blade configuration, and with molded blades formed of synthetic plastic material the overcoming of fracture and failure problems at the blade root can be achieved by using a high strength synthetic plastic, which is very costly, or the thickness of the blade in the root portion may be increased, which requires a significantly greater amount of blade material. Further, increasing the thickness of synthetic plastic fan blades at the root portion adjacent the hub has limitations in that as the thickness is increased the temperature of the blade material in the region of the thickened portion also increases as the blade flexes during operation. The strength of synthetic plastic materials is adversely affected by an increase in temperature, and while the use of a greater thickness of body material does increase the strength in the root portion, such increased masses also retain the heat and permit the heat to build to a temperature which actually reduces the strength of the blade material and can result in blade failure during extended periods of operation. Thus, while improved strength of synthetic plastic blades may be achieved by using more expensive material, such a solution is often economically impractical, and because of thermal strength loss the increasing of the amount of material at stress points is often self defeating.

The basic object of the invention is to provide a fan blade, preferably of synthetic plastic material, wherein the air flow capacity of the blade may be achieved with a minimum amount of blade material while providing resistance to failure, fracture, and other stress-related problems.

It is a further object of the invention to produce a fan blade wherein the load imposed on the blade is distributed over a greater area than usual, and wherein the stresses within the blade remain substantially constant throughout the blade length.

Another object of the invention is to provide a fan blade having the material thereof distributed in the most effective manner relative to a neutral bending axis as to avoid abrupt changes in the blade section modulus or moment of inertia wherein the stresses will remain substantially constant throughout the blade length.

An additional object of the invention is to provide a fan blade of such configuration as to avoid a concentration of load pressures and stresses and wherein stresses on the blade are substantially constant throughout the blade length and, yet, the thickness of the blade is relatively uniform throughout its length.

In the practice of the invention a fan blade, preferably formed of synthetic plastic material, is molded in such a manner that the blade is of a substantially uniform thickness throughout its length.

The blade includes a longitudinal axis, and at its outer region is of the conventional concave-convex configuration defining an air foil air flow portion which is moving at the greatest velocity and displaces the air to be pumped. The innermost region of the blade, i.e. the root, is affixed to a hub, or is integrally molded thereto, and a transition portion exists between the air flow portion and the root portion. It is the configuration of the blade in the transition portion wherein the invention is centered.

From the intersection of the air flow and transition portions radially inward to the root portion the configuration of the transition portion is such that the blade material is increasingly displaced away from the blade neutral bending axis. As the forces imposed on the blade increase toward the root portion, the increasing distance of the blade material from the neutral bending axis permits the blade material to better withstand the bending forces imposed thereon and the blade material is most effectively utilized.

The configuration of the blade through the transition portion is such that the blade material is judiciously located to avoid abrupt changes in the section modulus, torsion modulus and moment of inertia of the blade and the blade configuration, even though of a substantially uniform thickness, permits the stresses therein to remain fairly constant through the transition portion while the moment of inertia uniformly increases and the load imposed on the blade material is distributed over a greater area than accomplished with previous fan blade configurations. As the superior strength of the blade can be achieved without substantially increasing the amount of blade material required the practice of the invention results in significant economies of manufacture without a sacrifice in efficiency, strength, durability and safety factors.

BRIEF DESCRIPTION OF THE DRAWINGS

The aforementioned objects and advantages of the invention will be appreciated from the following description and accompanying drawings wherein.

DESCRIPTION OF THE PREFERRED EMBODIMENT

Figure 1:
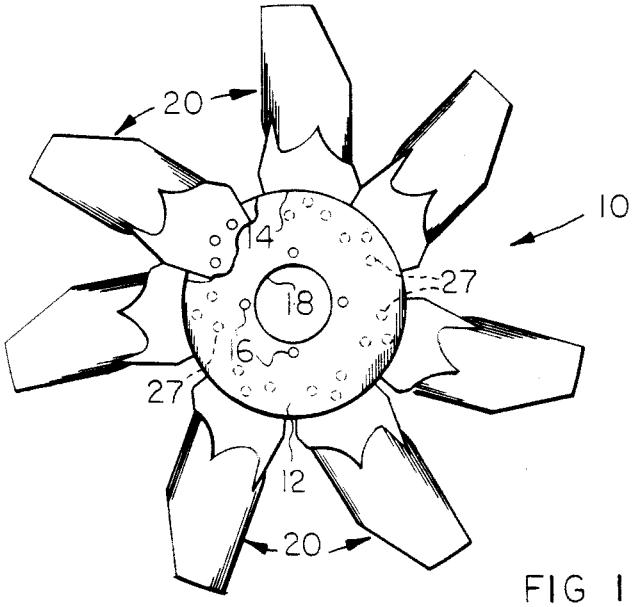
FIG. 1 is a front, elevational view of a fan assembly utilizing the concepts of the invention.
Figure 2:
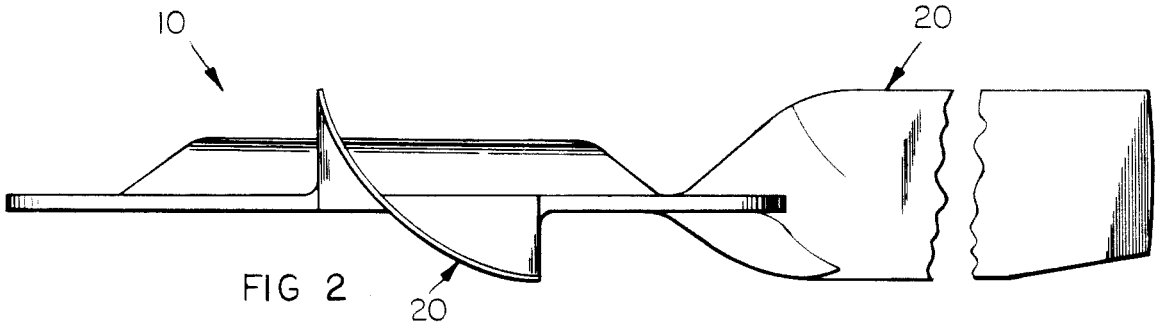
FIG. 2 is a side elevational view of the fan blade assembly of FIG. 1.

FIG. 1 illustrates a typical fan assembly 10 wherein a synthetic plastic blade in accord with the inventive concepts may be utilized. The assembly 10 includes a metal hub 12 of circular configuration having a peripheral region 14. The hub may be attached to a drive shaft, not shown, by bolts extending through holes 16 and a central opening 18 may cooperate with a projection defined on the drive shaft for assuring concentricity thereto. The peripheral region of the hub can include a plurality of holes wherein the blades, generally indicated at 20, may be affixed to the periphery of the hub at their root portion.

A blade constructed in accord with the invention is preferably primarily formed of a synthetic plastic material and includes air foil air flow portion 22 located adjacent the blade outer tip 23. The air flow portion 22 is of the conventional concave-convex configuration widely used with fans and constitutes the air displacement or pumping portion of the blade. This blade portion will be moving at the greatest velocity due to its greater distance from the center of the blade assembly 10, and the portion 22 will be angularly related to the axis of blade assembly rotation so as to provide the "bite" to achieve the desired air displacement and pumping capacity.

The innermost portion of the blade constitutes the root portion 24, and it is the root portion which is affixed to the hub 12. In the disclosed embodiment, the root portion 24 consists of a flat metal insert 24 which is molded into the innermost portion of the transition portion, as later described, and the root portion includes a plurality of holes 26 through which the hub rivets or fasteners 27 extend for attaching the blade to the hub 12. Various known techniques may be utilized to enhance the interconnection between the metal root portion 22 and the synthetic plastic blade material.

The transition portion 30 of the blade is defined intermediate the air flow and root portions. It is the configuration of the transition portion which produces the crux of the invention, and the configuration of the transition portion will be appreciated from the drawing figures.

The transition portion 30 includes a pair of ribs 32 and 34 which extend in a pointed manner toward the blade tip 23. The ribs each have an apex extending toward tip 23 while the base region near the root portion 24 is of the greatest width. The longitudinal axis of the blade 20 is indicated at 36, and the ribs 32 and 34 are located upon opposite sides thereof. As will be appreciated from the drawings, the rib 32, FIG. 3, extends toward the viewer projecting from the rear concave configuration of the blade, while the rib 34 extends away from the viewer. In FIG. 4 wherein the front convex portion of the blade is shown, the rib 34 will extend toward the viewer, while the rib 32 extends away from the viewer.

The configuration of the ribs 32 and 34 will be appreciated from the sectional views of FIGS. 5–9, and FIGS. 10–13, wherein it will be appreciated that the thickness of the blade slightly increases from Section V—V to Section VI—VI in the concave-convex air flow portion of the blade. Thereupon, through the transition portion 30 the blade thickness is substantially constant.

Figure 10:
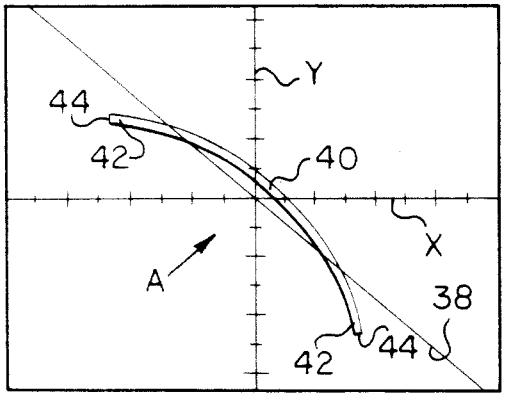
FIG. 10 is a graphical diagram of the transverse section of the blade illustrating the neutral bending axis and moment of inertia as taken along Section VI—VI of FIG. 3.

With respect to FIGS. 10–13, the theory of the invention will be appreciated. In FIG. 10 the Section VI—VI is illustrated, and X and Y axes are shown. The line 38 represents the neutral bending axis with respect to the primary bending forces that are imposed on the blade in the direction of its thinnest cross section, i.e. substantially at right angles to the neutral axis 38. With a bending force imposed in the direction of arrow A, it will be appreciated that the maximum compressive forces imposed on the blade will be at point 40, while the maximum tension forces will be at points 42 adjacent the blade lateral edges 44. The blade material adjacent the neutral axis 38 contirbutes little to the resistance of the blade to bending.

Figure 3:
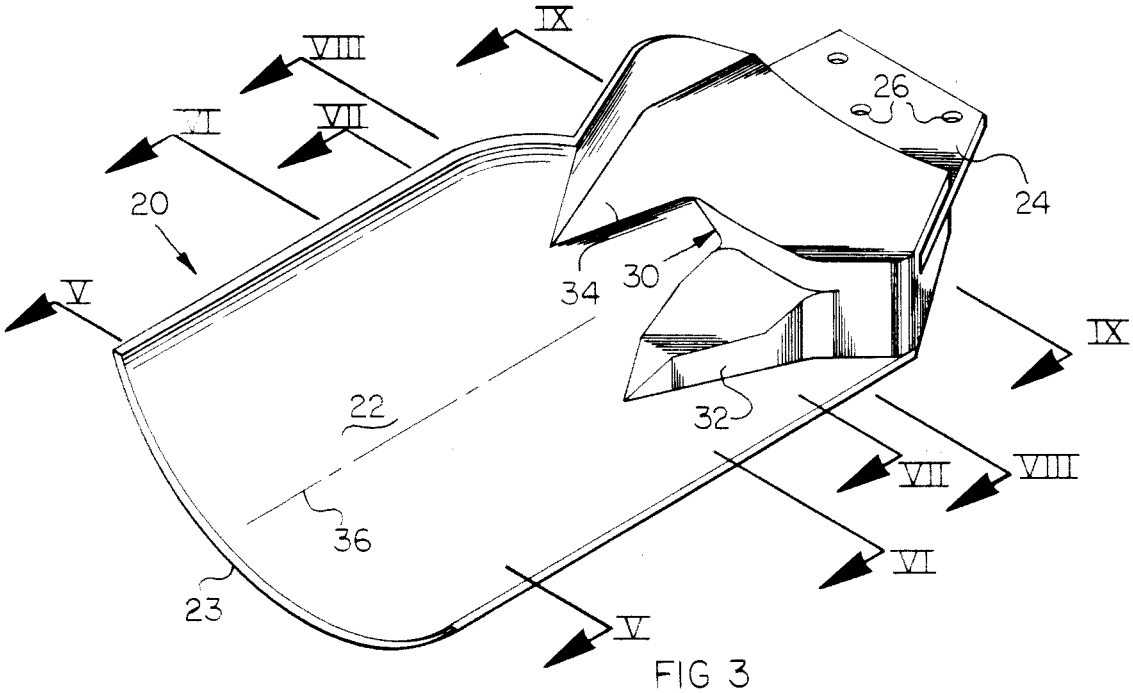
FIG. 3 is an enlarged, perspective view of the rear side of a fan blade in accord with the invention.
Figure 4:
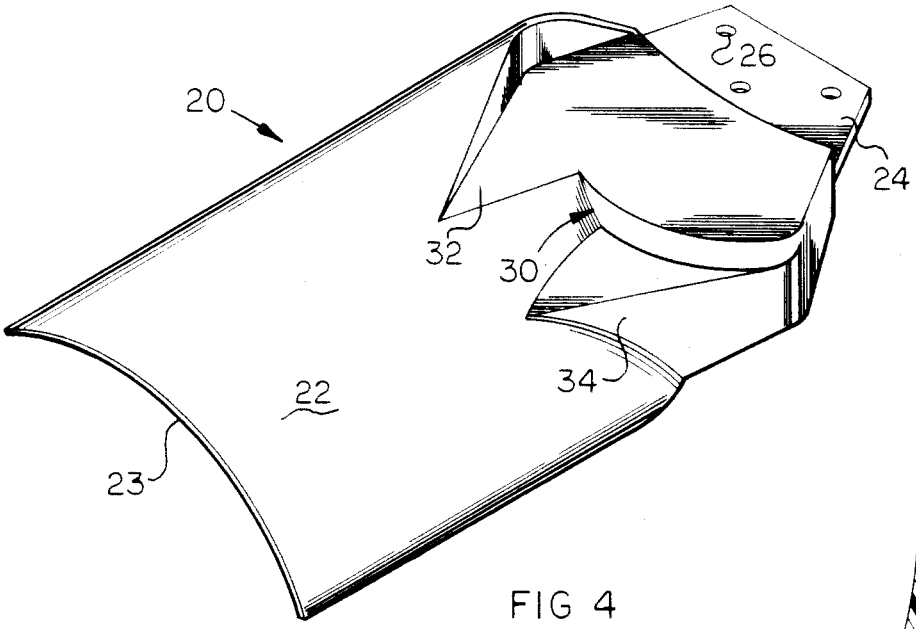
FIG. 4 is a perspective view of the front side of the fan blade shown in FIG. 3, FIGS. 5, 6, 7, 8 and 9 are section views as taken along Sections V—V, VI—VI, VII—VII, VIII—VIII and IX—IX of FIG. 3, respectively.
Figure 5:
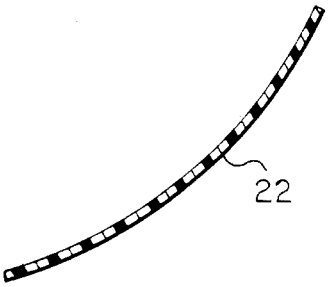
Figure 6:
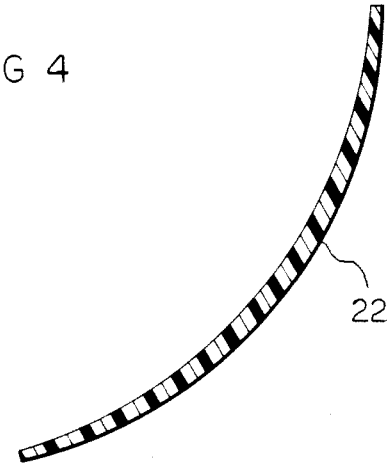
Figure 7:
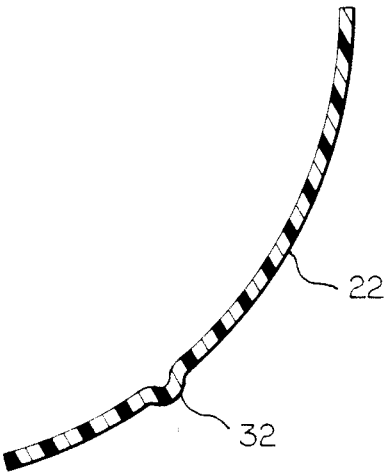
Figure 8:
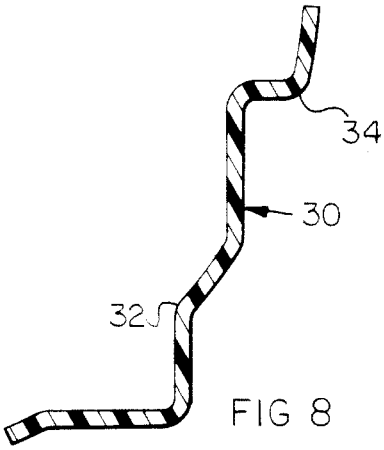
Figure 9:
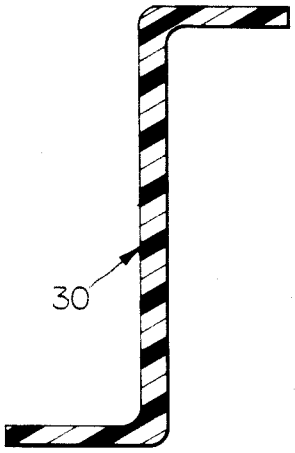
Figure 11:
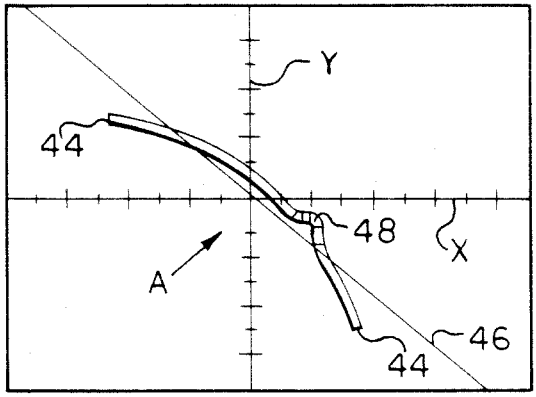
FIG. 11 is a graphical representation of the fan blade illustrating the neutral bending axis and moment of inertia and configuration as taken along Section VII—VII of FIG. 3.

FIG. 11 represents the configuration of the blade at Section VII—VII of FIG. 3 wherein a portion of the rib 32 appears. The neutral axis 46 is substantially in the same location as neutral axis 38, but has slightly shifted due to the presence of the rib 32, and the portion 48 of the rib will provide improved resistance to compression due to the greater distance of area of the rib portion 48 from the neutral axis 46 as compared to the distance between the point 40 and the neutral axis 38 of FIG. 10.

Figure 12:
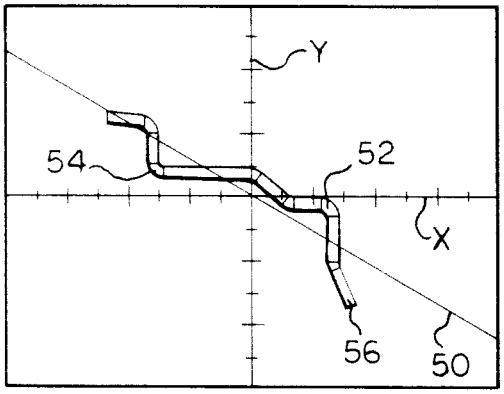
FIG. 12 is a graphical representation of the fan blade illustrating the neutral bending axis and moment of inertia and configuration as taken along Section VIII—VIII of FIG. 3.

FIG. 12 represents the section taken at Section VIII—VIII of FIG. 3, and it will be appreciated that the neutral bending axis 50 has shifted with respect to the X and Y coordinates as compared to FIGS. 10 and 11. This shifting of the bending axis is due to the change in the configuration of the blade at the section represented. The configuration of the blade material is now such that much of the blade material is at a relatively greater angle to the neutral axis 50 as compared to FIGS. 10 and 11 and significant distances exist between the blade points 52 and 54 and the neutral axis 50, as well as the distance between point 56 and the neutral axis. Point 52 will be under maximum compression, while points 54 and 56 provide effective resistance to tension forces about the bending axis 50.

Figure 13:
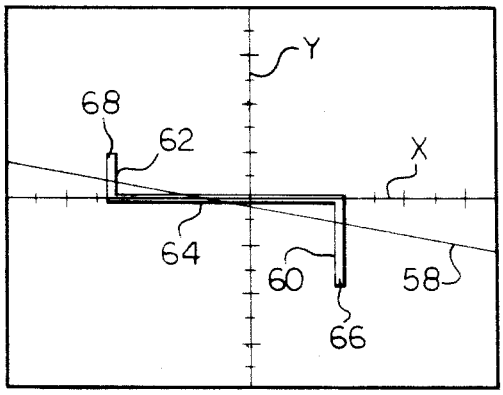
FIG. 13 is a graphical representation of the fan blade illustrating the neutral bending axis and moment of inertia and configuration as taken along Section IX—IX of FIG. 3.

The maximum resistance to bending forces is achieved with the configuration shown in FIG. 13 which represents Section IX—IX of FIG. 3. The neutral bending axis 58 has again changed with respect to the X and Y coordinates due to the change in configuration of the blade transition portion, and as the blade portions 60 and 62 are substantially at right angles to the portion 64 the blade point 66 will be under maximum tension, while maximum compressive forces are resisted at point 68. As the neutral axis 58 intersects the blade portions 60 and 62 at almost a right angle effective resistance to bending about axis 58 is achieved by the blade material.

The configuration of the ribs 32 and 34 from the intersection of the transition portion 30 with the air flow portion 22 and the root portion 24 is determined by a computer and the blade configuration is such as to locate the blade material relative to the neutral axis at each section throughout the length of the transition portion along the blade axis 36 such that a uniform change in configuration permits the various forces imposed on the blade during operation to be evenly distributed over the blade material area such that the stresses within the blade material remain substantially constant. As the thickness of the blade throughout the transition portion 30 is substantially uniform, heat will not be generated at any particular location and weaknesses due to thermal effects are eliminated. By moving the blade material away from the neutral bending axis, concentrations of forces and loading on the blade material are prevented and abrupt changes are avoided in the section modulus, torsion modulus and the moment of inertia of the blade which uniformly increases in the direction of the root portion.

Figure 14:
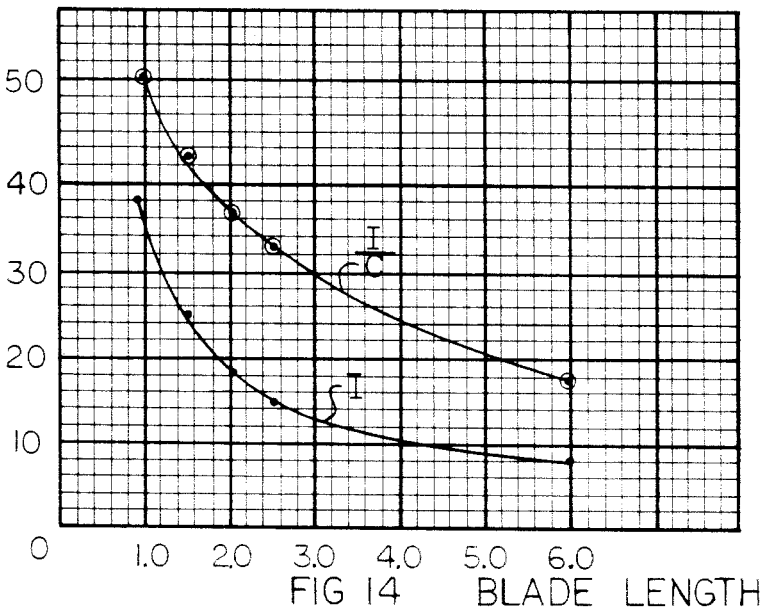
FIG. 14 is a graph illustrating the section modulus and moment of inertia of a fan blade in accord with the invention at various longitudinal positions along the blade.

The stress (S) imposed upon the blade equals the bending moment (M) times the distance (C) from the neutral axis as divided by the moment of inertia (I), and by increasing the moment of inertia, the denominator of the equation $S=MC/I$ becomes larger and the stresses are reduced. These relationships are indicated in FIG. 14.

It will therefore be appreciated that the practice of the invention permits a fan blade to be formed of a substantially uniform thickness, and with a minimum of material, and yet because of the optimum distribution of stresses and loading on the blade material, an effective blade life is achieved within required safety factors, and a blade formed in accord with the invention eliminates many of the problems heretofore present in fan blade design.

It is understood that various modifications to the inventive concepts may be apparent to those skilled in the art without departing from the spirit and scope of the invention.

I claim:

1. A fan blade characterized by its efficiency of material utilization comprising, in combination, an elongated blade body having an outer air flow portion, an inner root portion, a transition portion between said air flow and root portions and a longitudinal axis, a plurality of transverse sections defined on said blade body perpendicular to said body axis each having a neutral axis defining the minimum resistance to primary blade body bending, the material of said body being increasingly offset from said neutral axis from the intersection of said air flow and transition portions to said root portion such that the moment of inertia of said transverse sections from the intersection with said air flow portion to said root portion uniformly increases.

2. In a fan blade as in claim 1, at least one rib defined on said blade body from the material thereof forming said offset material and extending from the general configuration of said body in an increasing manner from the intersection of said air flow and transition portions to said root portion.

3. In a fan blade as in claim 2, first and second ribs defined on said blade body, the material of said first rib being located upon one side of said section's neutral axis and the material of said second rib being located upon the opposite side of said neutral axis.

4. In a fan blade as in claim 1, said blade body being molded of a synthetic plastic material.

5. The method of forming a fan blade having a body having an outer air flow portion, a root portion, a transition portion between the air flow and root portions and a longitudinal axis, each transverse section of said blade body perpendicular to the body axis having a neutral axis defining the minimum resistance to blade bending comprising the steps of determining the moment of inertia for adjacent transverse blade body sections from the intersection of the air flow and transition portions to the root portion, and locating the material of the blade body at adjacent sections at increasingly greater distances from the neutral axis of the associated section to provide a uniformly increasing moment of inertia at said sections.

6. The method of forming a fan blade as in claim 4 comprising the step of forming the blade of synthetic plastic material.

7. In a fan blade as in claim 1, wherein said blade body air flow and transition portions are of a substantially uniform thickness.

8. In a fan blade as in claim 4, wherein said blade body air flow and transition portions are of a substantially uniform thickness.

* * * * *